US006190845B1

(12) United States Patent
Sigemori

(10) Patent No.: US 6,190,845 B1
(45) Date of Patent: Feb. 20, 2001

(54) COLOR DEVELOPER COMPOSITION

(75) Inventor: Nobuki Sigemori, Matsudo (JP)

(73) Assignee: Chugai Phote Chemical Co., LTD, Tokyo (JP)

( * ) Notice: Under 35 U.S.C. 154(b), the term of this patent shall be extended for 0 days.

(21) Appl. No.: 08/535,582

(22) Filed: Sep. 28, 1995

Related U.S. Application Data

(63) Continuation of application No. 08/281,784, filed on Jul. 28, 1994, now abandoned.

(30) Foreign Application Priority Data

Jul. 28, 1993 (JP) ..... 5-205788
Jul. 28, 1993 (JP) ..... 5-205789
Oct. 15, 1993 (JP) ..... 5-281724

(51) Int. Cl.[7] ..... G03C 7/413
(52) U.S. Cl. ..... 430/486; 430/490
(58) Field of Search ..... 430/464, 484, 430/486, 487, 490

(56) References Cited

U.S. PATENT DOCUMENTS 4,800,153 * 1/1989 Morimoto et al. ..... 430/380
4,937,178 * 6/1990 Koboshi et al. ..... 430/375
5,250,396 * 10/1993 Ueda et al. ..... 430/439

* cited by examiner

*Primary Examiner*—Hoa Van Le
(74) *Attorney, Agent, or Firm*—Oldham & Oldham Co. LPA

(57) ABSTRACT

A process and a composition is described of a color developing agent for processing a silver halide color photographic material, the composition containing a paraphenylenediamine type color developing agent and an amine of formula (I) or a salt thereof $$R_1NR_2R_3 \quad (I)$$

wherein $R_1$ and $R_2$ are independently selected from alkyls, phenyls, hydrogen, and substituted derivatives thereof, such substituents including hydroxyl, alkoxyl, amide, sulfoneaminde and alkyl sulfoneamide groups, and $R_3$ represents an aromatic such as phenyl or naphthyl and substituents thereof. When used in highly concentrated solutions, the compositions are capable of preventing the precipitation of the color developer agent.

4 Claims, No Drawings

COLOR DEVELOPER COMPOSITION

This application is a continuation of application Ser. No. 08/281,784 filed on Jul. 28, 1994, now abandoned.

FIELD OF THE INVENTION

This invention relates to compositions of color developing agent and color developer compositions for processing silver halide color photographic material and a method of using the same. More specifically, the invention relates to compositions of aqueous solution of color developing agent having excellent stability in use and color developer compositions used in highly concentrated solution for color development processing wherein the compositions are capable of preventing precipitation of the color developer agent.

PRIOR ART

Among the basic process of color photographic material that are effected after exposure of the photographic material to a light image, are those of color developing, silver bleaching, silver halide fixing, bleaching fixing, in which a bleaching process and a fixing process are effected at a time, water washing, rinsing which is effected in lieu of the water washing process, stabilizing and drying. In addition, there are additional processes, which are executed to permit each process to be used stably or to increase the physical strength and stability of the processed photographic material. Among methods of processing silver halide color photographic materials are those of processing color negative films to obtain color prints, which are the methods most widely used today, and those for directly obtaining final images in the form of positive color films or prints. Further, users of color prints want to see the prints as soon as possible and desire the production of prints in as short a period of time as possible. To meet this demand, it is necessary to provide quick processing.

In recent years, it is possible to quickly process silver halide color photographic materials owing to improvements therein. In addition, easy processing of a large quantity of materials is possible with automatic developing apparatus. Further, the automatic developing apparatus has been improved, and a variety of compact and inexpensive apparatuses are used. An automatic developing apparatus is normally used for carrying out the above photographic process. In actual processing of a large quantity of photographic materials, the process of a given quantity of photographic material is carried out while replenishing with a necessary quantity of process solution as replenishment solution. A photographic material processor who accepts a request to process photographic material from a photographer has to effect the desired process in a short period of time.

In order to process a silver halide color photographic material easily and quickly, agents necessary for the processing are available on the market in the form of a liquid so that they can be used by simply diluting with water. Desired of these agents are easy usage and capability of being used without producing detriment to the surronding environment. These agents are supplied in various conditions, some of which are not suitable for use in a satisfactory environmental condition. In actual practice, a color develop for processing a silver halide color photographic material is supplied separately in three to four parts. The reason for this separation into a plurality of parts is to prevent the quality of the developer from deteriorating even in cases where there may be a long interval between the time the developer was produced and actually used and also to ensure that composition of each part of solution is such that it does not present any problem when mixed with other solutions. Of those various solutions, color developing agent is oxidized by silver halide exposed to light and then, reacting with coupler contained in the silver halide color photographic material, generates a pigment image. The developing agent used is of a paraphenylene diamine type, which, when as a liquid, has to be in the form of a concentrated aqueous solution and also has to be stable even when subjected to various storage conditions. As a paraphenylene diamine type color developing agent tends to be oxidized in storage, it is normally prepared as concentrated aqueous solution with sulfurous compound being added to prevent oxidation of the agent. Examples of methods for improving stability of compositions of color developing agents supplied in the form of aqueous solution are shown in Japanese Patent Publication No. 37957/1970, like Publication No. 24050/1973, Japanese Patent Application Public Disclosure No. 136045/1988, like Disclosure No. 181245/1993 and U.S. Pat. Nos. 3,615,572, 3,647,461 and 3,647,462. All of the aforementioned, however, call for using sulfurous compounds and therefore present a problem in that sulfur dioxide is generated.

There are trends towards reducing the time and the quantity of solutions required for processing silver halide color photographic material. Reducing the time required for processing is advantageous in improving the efficiency of photographic processing and also in making automatic developing apparatuses compact. Reducing the size of an automatic developing apparatus results in reduction of the quantity of solutions used for processing, which means that the quantity of waste liquid is reduced. In conducting the photographic processing, for which an automatic developing apparatus is normally used, the process of a given quantity of photographic material is carried out while feeding solutions necessary for processing into the automatic developing apparatus as replenishment solutions, the quantity of each replenishment solution being in proportion to the quantity of the photographic material to be processed, and used solutions are overflowed from the apparatus and discharged. The discharged waste liquid is collected for batch disposal. As automatic developing apparatus have been made compact, they can be now installed anywhere their users wish, and, as a result, they are sometimes installed where it is difficult to provide plumbing for disposal of overflow waste liquid. This is why waste liquid has to be collected as described above. With regard to environmental pollution, the overflow liquid cannot be disposed of directly but has to be collected and treated before being discharged into the environment. Regarding collection of overflow waste liquid, naturally, the less the quantity of waste liquid, the better in view of the cost and frequency required for the collection. Therefore, various methods for reducing overflow liquid have recently been provided and put into actual practice. Examples of these methods include those utilizing ion exchange resin, color developer revitalizing methods utilizing electrodialysis, revitalization of color developer simply by using a regenerant, and low-volume replenishing processing methods involving increase of concentration of components of replenishement solutions. Revitalization of color developer is comprised of removal of insoluble sediment and replenishment of insufficient components, or, simply, of replenishment of insufficient components. Although color developer solutions can be revitalized by the above methods, a special device, space and/or procedures, such as, analysis of components of developing solutions in order to stabilize the quality of photographs, are necessary to implement these methods. In this regard, revitalization presents many problems including time and operational complications involved with its execution. On the other hand, methods calling for using only a small quantity of highly concentrated replenishment solutions are probably most appropriate, because they require neither a special device nor procedures. However, they present another problem in that, when preparing color developer solution, color developing agent having a low solubility under a high pH precipitates in the form of a crystal at a low temperature. As crystals thus precipitated are hard to dissolve, they tend to cause serious problems including abnormality in composition of color developer, clogging up of the circulation system of an automatic developing apparatus and damages to photographic material by the precipitate. Examples of methods for solving this problem include those utilizing paratoluenesulfonic acid disclosed in Japanese Patent Application Public Disclosure No. 147138/1992 and Japanese Patent Application No. 130383/1991, those utilizing cellulosic compound disclosed in Japanese Patent Publication No. 41676/1971 and like Publication No. 21250/1975, those utilizing polyvinyl compound disclosed in Japanese Patent Publication No. 20743/1972 and like Publication No. 16179/1983, one utilizing an unsaturated polymer of ethylene series disclosed in Japanese Patent Publication No. 35535/1985, those utilizing an interfacial active agent disclosed in Japanese Patent Application Public Disclosure No. 178833/1990, like Disclosure No. 37847/1992 and like Disclosure No. 350855/1992, and those utilizing dissolving agents for color developing agents disclosed in Japanese Patent Publication No. 60636/1992, like Disclosure No. 81751/1992, like Disclosure No. 127330/1993 like Disclosure No. 81751/1992, like Disclosure No. 188551/1993 and like Disclosure No. 188552/1993. Although these methods are effective in increasing the concentration of color developing agent to a certain extent, they are insufficient for ultra low-volume replenishing processing, and, therefore, there is a demand for a more improved method of preventing precipitation of color developing agent.

As color developing agent used for processing silver halide color photographic materials is the key composition for photographic processing, its stability is especially important. Therefore, a large quantity of a sulfite compound is usually used in order to improve the stability of the color developing agent while in storage. In Japanese Patent Publication No. 37957/1970, however, it is described that excessive use of a sulfite compound may cause abnormality in a pigment image. Another problem of using a sulfite is its adverse environmental effects. As described in Japanese Patent Publication No. 37957/1970, the preferable pH range for concentrated solution is pH 4 and below, the optimum condition being not more than pH 1. As the solution is so strongly acid, it generates an irritant gas due to gasification of a sulfite compound used as an antioxidant. This sulfur dioxide strongly irritates mucosa and may cause pain in the chest and the throat or even difficulty in breathing. Therefore, color developing agent whose composition does not contain a sulfur dioxide producing sulfite compound and has excellent stability while being in storage is desirable.

The inventors conducted research and investigations concerning a color developer composition to be supplied as an aqueous solution free from the danger of generating sulfur dioxide, a method of maintaining the solution stable, and also a method of preventing crystallized precipitation of color developing agent in a concentrated color developer solution. As a result, it was found that composition of color developing agent containing a particular compound does not produce sulfur dioxide and is excellently stable and that a color developer composition containing the said particular compound does not cause crystallized precipitation even when it is used as concentrated color developer solution, thus composition containing said compound is capable of solving the above problems. The present invention is predicated in this finding.

An object of the invention, accordingly, is to provide a color developer composition which does not produce sulfur dioxide and is excellently stable when used as composition of color developing agent and does not cause crystallized precipitation when used as concentrated color developer solution.

DESCRIPTION OF THE INVENTION

In processing a silver halide color photographic material, an object of the present invention is attained by a color developer composition which does not produce sulfur dioxide and is excellently stable when used as composition of color developing agent and does not cause crystallized precipitation when used as concentrated color developing process solution, wherein composition of color developing agent containing a paraphenylene diamine type color developing agent and also a compound given by the general formula below or a salt thereof, and a color developer composition containing paraphenylene diamine type color developing agent and also a compound given by the general formula below or a salt thereof are used.

General Formula:

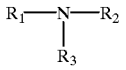

In the general formula, $R_1$ and $R_2$ independently represent an alkyl group, an allyl group or a hydrogen atom, any of which may be substituted for by a hydroxyl group, a carboxyl group, an alkoxyl group, an amide group, a sulfoneamide group or an alkyl sulfoneamide group. $R_3$ represents a phenyl group or a naphthyl group, any of which may be substituted for by a hydroxyl group, a carboxyl group, an alkoxyl group, an amide group, a sulfoneamide group, a nitroso group, or an alkyl group which may be substituted for by any of these groups.

At present, a large variety of silver halide photographic materials are commercially available. Depending on their purposes, they are available in different forms, for example, color negative films, color reversal films, and color printing materials, such as negative-positive printing materials and positive—positive printing materials. Among those, color negative films and positive printing materials are usually used. These many different silver halide color photographic materials have different laminar structures and their own features. There is also a tremendous variety of silver halide compositions constituting these layers. Further, the differences in the quantities of silver chloride, silver bromide and silver iodide used, the differences in the composition ratio, particle sizes and shapes of silver halide grains provide for respective features. Furthermore, various additives including sensitivity-increasing pigments, stabilizers, intensifiers and restrainers are used. The aforementioned particle size is dealt with in, for example, *Basis of Photographic Industry—Silver-Salt Photography,* edited by the Society of Photographic Science and Technology of Japan and published by Corona Co., Ltd., p-p. 277–278. Further, silver halide color photographic materials use various couplers, for which numerous kinds of compounds are used. The present invention is applicable to all and any silver halide color photographic materials having compositions and components described above.

For processing a silver halide color photographic material, usually an automatic developing apparatus is used. There is a great variety of automatic developing apparatus, which are different in type, processing speed, temperature of process, process steps, method of replenishment with replenishment solutions, method of dealing with over-flow solution and so forth and have their own features. The present invention is applicable to all and any automatic developing apparatus having various structures described above.

Compounds given by the general formula and used for the present invention are either commercially available or can be obtained with reference to a synthesis procedure shown in *Berichite?*22, 2092 (1951) or *Journal of American Chemical Society,* 73 3100 (1951). Examples of those compounds are shown below, and salts of those compounds include sulfates, hydrochlorides, nitrates and paratoluenesulfonates. These examples, however, do not in any sense limit the scope of the present invention.

(1)

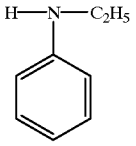

(2)

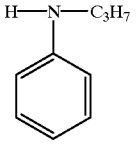

(3)

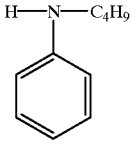

(4)

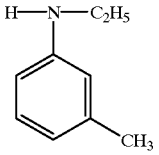

(5)

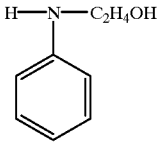

(6)

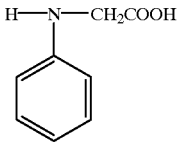

-continued (7)

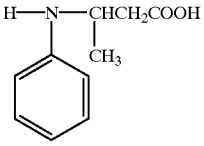

(8)

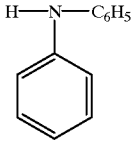

(9)

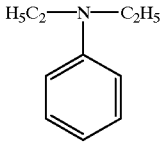

(10)

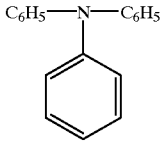

(11)

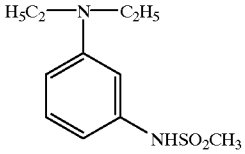

(12)

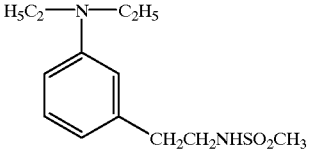

(13)

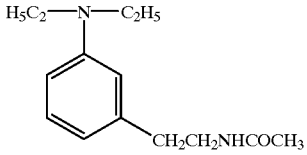

(14)

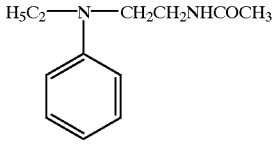

(15)

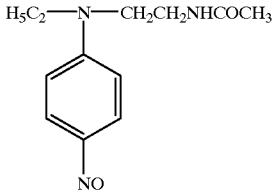

-continued
(16)
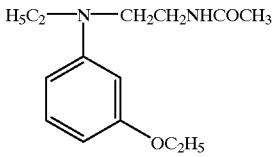
(17)
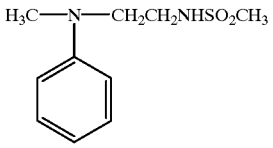
(18)
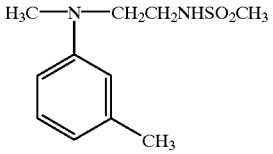
(19)
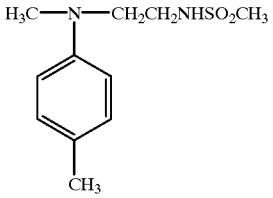
(20)
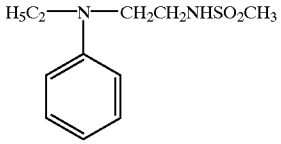
(21)
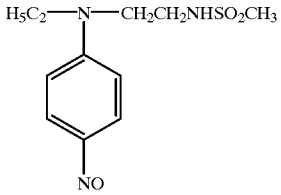
(22)
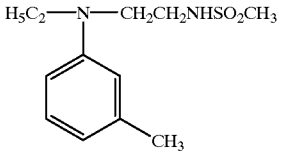
(23)
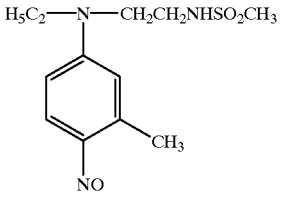
-continued
(24)
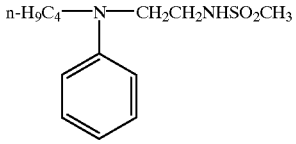
(25)
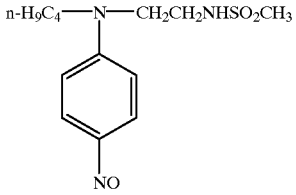
(26)
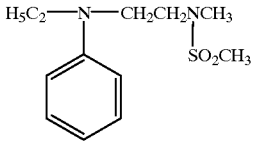
(27)
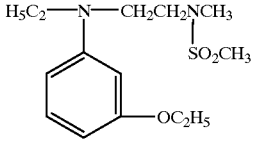
(28)
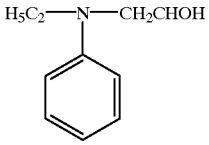
(29)
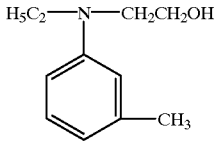
(30)
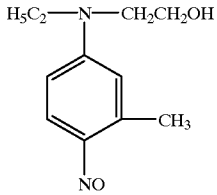
(31)
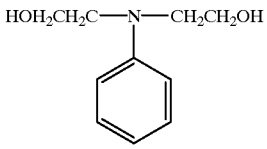
(32)
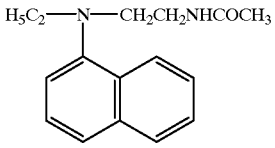

-continued (33)

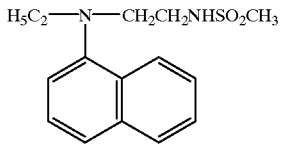

Examples of the color developing agents of paraphenylenediamine type used according to the present invention are shown in *Journal of American Chemical Society,* 73 3100 (1951) and Haist, *Modern Photographic Processing,* 1979, John Wily and Sons, New York, p. 545 and following pages.

Color developer compositions used according to the present invention may contain various usual components, examples of which include such alkali compounds as potassium hydroxide, sodium hydroxide, potassium carbonate, sodium carbonate, potassium phosphate and sodium phosphate, such sulfites, hydrosulfites and metabisulfites as sodium sulfite, potassium sulfite, sodium hydrosulfite, potassium hydrosulfite, sodium metabisulfite and potassium metabisulfite, such halides as potassium chloride, sodium chloride, potassium bromide, sodium bromide, potassium iodide and sodium iodide, such water-softening agents as aminopolycarbonic acid, polystylene sulfonic acid and polyphosphonic acid, such thickening agents as ethylene glycol, diethylene glycol, diethanolamine and triethanolamine, and development acceleration agents. Furthermore, such compounds as nitrobenzoimidazol, mercaptobenzoimidazol, 5-methyl-benzotriazol and 1-phenyl-5-mercaptotetrazol, anti-stain agents, anti-sludge agents, fluorescent whitening agents and so forth may be used as additives.

In order that the invention may be more easily understood and readily carried into effect, embodiments thereof are now described by way of non-limiting example only.

EMBODIMENT 1

Aqueous solution comprising the composition of color developing agent according to Table 1 was prepared and bottled in 200 ml polyethylene containers. Then, the containers were capped and placed in a 50° C. thermostat (Platinous Unicool PU-2G: a product of Tabai Mfg. Co.) for 200 hours, during which the bottles were uncapped once a day to conduct a test in room temperature over a period of 30 minutes per day to observe stability of each composition of color developing agent.

TABLE 1

| Test No. | Color developing agent (A) | Compound of the Invention | Quantity of Solution |
|---|---|---|---|
| 1 | 50 g | — | 100 ml |
| 2 | 50 g | (B) 0.5 g | 100 ml |
| 3 | 50 g | (1) 2 g | 100 ml |
| 4 | 50 g | (4) 3 g | 100 ml |
| 5 | 50 g | (22) 2 g | 100 ml |
| 6 | 50 g | (22) 4 g | 125 ml |
| 7 | 50 g | (31) 2 g | 100 ml |
| 8 | 50 g | (C) 2 g | 125 ml |

Color developing agents (A) and (B) are respectively 4-amino-3-methyl-N-ethyl-N-(β-methylsulfonamidoethyl) aniline 3/2-sulfate 1-hydrate and sodium hydrosulfite. Color developing agents (C) is a sulfate of a compound according to the present invention and obtained in the form of a crystal by means of dissolving 12.8 g of 3-methyl-N-ethyl-N-(β-methylsulfonamide ethyl)aniline in 50 ml of acetone and adding 4.9 of sulfuric acid to the solution.

The following color developer and processing solutions were prepared by using solutions respectivley comprising the compositions of color developing agents shown in Table 1 and compositions of color developing agents which have undergone the stability test. Then, commercially available color paper was exposed to a specified light by means of a photographic sensitometer and then processed under the steps shown in Table 2 below.

TABLE 2

| Process | Temperature | Time |
|---|---|---|
| Color developing | 35° C. | 45 sec. |
| Bleaching fixing | 33 to 36° C. | 45 sec. |
| Stabilizing | 33 to 36° C. | 90 sec. |
| Drying | 70 to 85° C. | 60 sec. |

| Color developer solution | |
|---|---|
| Diethylenetriamine pentaacetic acid | 2.0 g |
| Sodium chloride | 8.0 g |
| Potassium carbonate (anhydrous) | 25.0 g |
| Diethylhydroxylamine | 2.5 g |
| Sodium sulfite (anhydrous) | 0.2 g |
| Phosphorus white-increasing agent (UVITEX MST by CIBA-GEIGY) | 4.0 g |
| Composition of color developing agent shown in Table 1 (sufficient quantity to bring the agent to 5 g) | |
| Water: sufficient quantity to bring the total volume of the solution to: | 1.0 l |
| pH (adjusted with potassium hydroxide) | 10.0 |
| **Bleaching fixing solution** | |
| Ammonium thiosulfate | 70.0 g |
| Sodium sulfite (anhydrous) [22] | 17.0 g |
| Ammonium ethylenediamine iron (III) tetraacetate | 55.0 g |
| Disodium ethylenediamine tetraacetate | 5.0 g |
| Water: sufficient quantity to bring the total volume of the solution to: | 1.0 l |
| pH (adjusted with acetic acid) | 6.0 |
| **Stabilizing solution** | |
| 2-aminobenzothiazol | 0.1 g |
| 1-hydroxyalkylidene-1-diphosphonic acid | 4.0 g |
| Water: sufficient quantity to bring the total volume of the solution to: | 1.0 l |
| pH (adjusted with sodium hydroxide) | 6.0 |

The respective densities of the minimum density part (Dmin.), the low density part (LD) and the high density part (HD) of the processed photographic materials were measured to determine the difference between the densities of the high density part and the low density part as contrast (HD−LD) and also to find the difference between the result of using compositions of color developing agent before the stability test and the result of using the same compositions after the stability test, the said difference being determined by measuring the change in the minimum density (ΔDmin), the sensitivity change (ΔLD) and the contrast change (ΔHD−LD). The measurement was made using a reflecting density meter ("X-RITE310"). The results are as shown in Table 3, wherein $\hat{1}$, $\hat{2}$ and $\hat{3}$ respectively represent the blue, green and red color densities.

TABLE 3

| Test No. | | ΔDmin. | ΔLD | ΔHD-LD |
|---|---|---|---|---|
| 1 | ① | 0.02 | −0.15 | −0.10 |
| | ② | 0.04 | −0.48 | −0.17 |
| | ③ | 0.01 | −0.35 | −0.12 |
| 2 | ① | 0.02 | −0.02 | −0.01 |
| | ② | 0.01 | −0.04 | 0.00 |
| | ③ | 0.00 | −0.03 | −0.02 |
| 3 | ① | 0.01 | −0.06 | −0.01 |
| | ② | 0.02 | −0.12 | 0.01 |
| | ③ | 0.00 | −0.08 | −0.03 |
| 4 | ① | 0.02 | −0.04 | 0.00 |
| | ② | 0.02 | −0.06 | −0.01 |
| | ③ | 0.00 | −0.04 | −0.02 |
| 5 | ① | 0.01 | −0.04 | 0.01 |
| | ② | 0.01 | −0.06 | −0.01 |
| | ③ | 0.00 | −0.04 | −0.01 |
| 6 | ① | 0.02 | −0.02 | 0.01 |
| | ② | 0.01 | −0.04 | −0.02 |
| | ③ | 0.00 | −0.03 | −0.01 |
| 7 | ① | 0.02 | −0.06 | 0.00 |
| | ② | 0.02 | −0.10 | 0.01 |
| | ③ | 0.01 | −0.06 | −0.02 |
| 8 | ① | 0.02 | −0.05 | 0.01 |
| | ② | 0.01 | −0.08 | 0.00 |
| | ③ | 0.01 | −0.05 | −0.01 |

As is seen from the above results, in the same manner as composition (2) of color developing agent containing a sulfite compound, compositions of color developing agent containing compounds according to the present invention result in less increase of the minimum density (Dmin.) as well as less decrease of the densities in the low density part (LD) and the high density part (HD) compared with composition (1) of color developing agent, which does not contain a stabilizing agent. Therefore, it is evident that compounds according to the present invention are excellent in their performance as a stabilizer and also in that they do not have an unpleasant odor.

EMBODIMENT 2

Aqueous solutions comprising the compositions of color developing agents according to Table 4 were prepared and respectively bottled in 200 ml polyethylene containers. Then, the containers were capped and placed in a 50° C. thermostat (Platinous Unicool PU-2G: a product of Tabai Mfg. Co.) for 200 hours, during period the bottles were uncapped once a day to conduct a test in room temperature over a period of 30 minutes per day to observe stability of each composition of color developing agent.

TABLE 4

| Test No. | Color developing agent (D) | Compound of the Invention | Quantity of Solution |
|---|---|---|---|
| 9 | 50 g | — | 100 ml |
| 10 | 50 g | (E) 0.3 g | 100 ml |
| 11 | 50 g | (1) 3 g | 100 ml |
| 12 | 50 g | (4) 3 g | 100 ml |
| 13 | 50 g | (22) 2 g | 100 ml |
| 14 | 50 g | (22) 4 g | 100 ml |
| 15 | 50 g | (C) 2 g | 100 ml |

Color developing agents (D) and (E) are respectively 4amino-3-methyl-N-ethyl-N-(β-hydroxyethyl)aniline sulfate 1-hydrate and sodium hydrosulfite. Color developing agents (C) is the same compound of embodiment 1.

The following color developer solution and processing solutions were prepared by using respective solutions of compositions of color developing agent shown in Table 4 as well as compositions of color developing agent which have undergone the stability test. Then, commercially available color negative film was exposed to a specified light by means of a photographic sensitometer and then processed under the steps shown in Table 5 below.

TABLE 5

| Process | Temperature | Time |
|---|---|---|
| Color developing | 38° C. | 3 min. 15 sec. |
| Bleaching | 35 to 40° C. | 6 min. |
| Fixing | 35 to 40° C. | 3 min. 15 sec. |
| Washing (w. flowing water) | 25 to 35° C. | 2 min. 10 sec. |
| Stabilizing | 25 to 38° C. | 1 min. |
| Drying | 40 to 70° C. | |

| | |
|---|---|
| Color developer solution | |
| Potassium carbonate (anhydrous) | 30.0 g |
| Sodium sulfite (anhydrous) | 0.5 g |
| Sodium bromide | 1.3 g |
| Hydroxylamine sulfate | 2.0 g |
| Diethylenetriamine pentaacetic acid | 2.0 g |
| Composition of color developing agent shown in Table 4 (sufficient quantity to bring the agent to 4.5 g) | |
| Water: sufficient quantity to bring the total volume of the solution to: | 1.0 l |
| pH (adjusted with potassium hydroxide) | 10.0 |
| Bleaching solution | |
| Ammonium ethylenediamine iron (III) tetraacetate | 100.0 g |
| Disodium ethylenediamine tetraacetate | 5.0 g |
| Ammonium bromide | 150.0 g |
| Glacial acetic acid | 10.0 g |
| Water: sufficient quantity to bring the total volume of the solution to: | 1.0 l |
| pH (adjusted with ammonia water) | 6.0 |
| Fixing solution | |
| Ammonium thiosulfate | 120.0 g |
| Disodium ethylenediamine tetraacetate | 1.0 g |
| Sodium hydroxide | 2.5 g |
| Water: sufficient quantity to bring the total volume of the solution to: | 1.0 l |
| pH (adjusted with acetic acid) | 6.0 |
| Stabilizing solution | |
| "Wettol" (a product of Chugai Shashin Yakuhin Co., Ltd.) | 5.0 ml |
| Formalin (37%) | 1.0 ml |
| Water: sufficient quantity to bring the total volume of the solution to: | 1.0 l |

The respective densities of the minimum density part (Dmin.), the low density part (LD) and the high density part (HD) of the processed photographic materials were measured to determine the difference between the densities of the high density part and the low density part as contrast (HD−LD) and also to find the difference between the result of using compositions of color developing agent before the stability test and the result of using the same compositions after the stability test, the said difference being determined by measuring the change in the minimum density (ΔDmin), the sensitivity change (ΔLD) and the contrast change (ΔHD−LD). The measurement was made using a transmission type density meter ("X-RITE310"). The results are as shown in Table 6, wherein $\hat{1}$, $\hat{2}$ and $\hat{3}$ respectively represent the blue, green and red color densities.

TABLE 6

| Test No. | | ΔDmin. | ΔLD | ΔHD-LD |
|---|---|---|---|---|
| 9 | ① | 0.02 | −0.17 | −0.05 |
| | ② | 0.03 | −0.20 | −0.07 |
| | ③ | 0.01 | −0.22 | −0.10 |
| 10 | ① | 0.01 | −0.02 | −0.01 |
| | ② | 0.00 | 0.01 | 0.00 |
| | ③ | 0.02 | 0.00 | −0.01 |
| 11 | ① | 0.00 | −0.01 | −0.01 |
| | ② | 0.01 | 0.00 | 0.00 |
| | ③ | 0.00 | −0.02 | −0.01 |
| 12 | ① | 0.01 | −0.02 | −0.01 |
| | ② | 0.01 | 0.01 | 0.00 |
| | ③ | 0.00 | −0.01 | −0.01 |
| 13 | ① | 0.01 | −0.02 | −0.01 |
| | ② | 0.00 | −0.01 | 0.00 |
| | ③ | 0.00 | −0.02 | 0.01 |
| 14 | ① | 0.01 | −0.02 | −0.01 |
| | ② | 0.00 | 0.00 | 0.01 |
| | ③ | 0.01 | −0.01 | 0.01 |
| 15 | ① | 0.01 | −0.01 | −0.01 |
| | ② | 0.02 | −0.02 | −0.01 |
| | ③ | 0.01 | 0.00 | 0.00 |

As is seen from the above results, in the same manner as composition (10) of color developing agent containing a sulfite compound, compositions of color developing agent containing compounds according to the present invention result in less increase of the minimum density (Dmin.) as well as less decrease of the densities in the low density part (LD) and the high density part (HD) compared with composition (9) of color developing agent which does not contain a stabilizing agent. Therefore, it is evident that compounds according to the present invention are excellent in their performance as a stabilizer and also in that they do not have an unpleasant odor.

EMBODIMENT 3

Color developing compositions were prepared by dissolving the following components.

| Color developer solution | |
|---|---|
| Diethylenetriamine pentaacetic acid | 2.0 g |
| Sodium chloride | 1.5 g |
| Potassium carbonate (anhydrous) | 25.0 g |
| Diethylhydroxylamine | 5.0 g |
| Sodium sulfite (anhydrous) | 0.3 g |
| Phosphorus white-increasing agent (UVITEX MST by CIBA-GEIGY) | 7.5 g |
| Anti-precipitation agent shown in Table 7 | See Table 7 |
| 4-amino-3-methyl-N-ethyl-N-(β-methylsulfonamidoethyl) aniline 3/2-sulfate 1-hydrate | See Table 7 |

Anti-Precipitation Agent Shown in Table 7 See Table 7

4-amino-3-methyl-N-ethyl-N-(β-methylsulfonamidoethyl)aniline 3/2-sulfate 1-hydrate See Table 7

Water: sufficient quantity to bring the total volume of the solution to: 1.0 l pH (adjusted with potassium hydroxide) See Table 7.

The color developer compositions prepared as above were stored for one week, with the storage temperature being changed between 25° C. and −5° C. once a day using a thermostat (Platinous Unicool PU-2G: a product of Tabai Mfg. Co.) to observe the state of the compositions. The result of the test is as shown in Table 7.

TABLE 7

| Test No. | Anti-precipitation Agent | Color developing agent | pH | Precip-tation |
|---|---|---|---|---|
| 16 | — | $1.6 \times 10^{-2}$ mol | 10.4 | ○ |
| 17 | — | $1.8 \times 10^{-2}$ mol | 10.7 | X |
| 18 | p-Ts, 10.0 g | $1.8 \times 10^{-2}$ mol | 10.7 | ○ |
| 19 | (20), 0.5 g | $1.8 \times 10^{-2}$ mol | 10.7 | ○ |
| 20 | (26), 0.5 g | $1.8 \times 10^{-2}$ mol | 10.7 | ○ |
| 21 | p-Ts, 10.0 g | $2.3 \times 10^{-2}$ mol | 11.0 | X |
| 22 | p-Ts, 20.0 g | $2.3 \times 10^{-2}$ mol | 11.0 | X |
| 23 | (12), 0.5 g | $2.3 \times 10^{-2}$ mol | 11.0 | ○ |
| 24 | (20), 0.5 g | $2.3 \times 10^{-2}$ mol | 11.0 | ○ |
| 25 | (22), 0.5 g | $2.5 \times 10^{-2}$ mol | 11.0 | ○ |
| 26 | (14), 0.5 g | $2.5 \times 10^{-2}$ mol | 11.0 | ○ |
| 27 | (21), 0.3 g | $2.7 \times 10^{-2}$ mol | 11.0 | ○ |
| 28 | (33), 0.3 g | $2.7 \times 10^{-2}$ mol | 11.0 | ○ |
| 29 | (C), 0.3 g | $2.7 \times 10^{-2}$ mol | 11.0 | ○ |

p-Ts is paratoluenesulfonate.
(C) is the same compound as of embodiment 1.

As is seen from the above results, in cases where the quantity of color developing agent is on the order of $1.8 \times 10^{-2}$ mol per liter, it is possible to prevent precipitation of color developing agent by adding paratoluenesulfonate. In cases if highly concentrated solution on the order of $2.3 \times 10^{-2}$ mol per liter, however, precipitation of color developing agent is not prevented even when the quantity of paratoluenesulfonate added is increased (Test Nos. 21 and 22). On the other hand, it is evident from the results of Test Nos. 23 to 29 that precipitation of color developing agent can be easily prevented by means of adding only 0.5 g of compounds according to the present invention to each liter of color developer composition.

EMBODIMENT 4

Commercially available color paper was exposed to a light image and then processed under the steps shown in Table 8 below and using the following solutions.

TABLE 8

| Process | Temperature | Time | Replenishing quantity |
|---|---|---|---|
| Color developing | 35° C. | 45 sec. | 100 ml (I), 80 ml (II) |
| Bleaching fixing | 33 to 36° C. | 45 sec. | 220 ml |
| Stabilizing | 30 to 36° C. | 90 sec. | 250 ml |
| Drying | 70 to 85° C. | 60 sec. | |

Each replenishing quantity shown in the table represent a quantity replenished for each square meter of photographic material.

Color developer solution

| | |
|---|---|
| Diethylenetriamine pentaacetic acid | 2.0 g |
| Sodium chloride | 8.0 g |
| Potassium carbonate (anhydrous) | 25.0 g |
| Diethylhydroxylamine | 2.7 g |
| Sodium sulfite (anhydrous) | 0.2 g |
| Phosphorus white-increasing agent (UVITEX MST by CIBA-GEIGY) | 4.0 g |
| Anti-precipitation agent shown in Table 9 | See Table 9 |
| 4-amino-3-methyl-N-ethyl-N-(β-methylsulfonamide-ethyl) aniline 3/2-sulfate 1-hydrate | $1.2 \times 10^{-2}$ mol |
| Water: sufficient quantity to bring the total volume of the solution to: | 1.0 l |
| pH (adjusted with potassium hydroxide) | 10.05 |

| Color Developer replenishment solution | (I) | (II) |
|---|---|---|
| Diethylenetriamine pentaacetic acid | 2.0 g | 2.0 g |
| Sodium chloride | 1.5 g | 0.5 g |

TABLE 8-continued

| | | |
|---|---|---|
| Potassium carbonate (anhydrous) | 25.0 g | 25.0 g |
| Diethylhydroxylamine | 4.0 g | 5.4 g |
| Sodium sulfite (anhydrous) | 0.3 g | 0.3 g |
| Phosphorus white-increasing agent (UVITEX MST by CIBA-GEIGY) | 4.0 g | 7.5 g |
| Anti-precipitation agent shown in Table 9 | See Table 9 | |
| 4-amino-3-methyl-N-ethyl-N-(β-methylsulfonamidoethyl) aniline 3/2-sulfate 1-hydrate | $2.0 \times 10^{-2}$ mol | $2.5 \times 10^{-2}$ mol |
| Water: sufficient quantity to bring the total volume of the solution to: | 1.0 l | 1.0 l |
| pH (adjusted with potassium hydroxide) | 10.60 | 11.00 |

| Bleaching fixing solution (as both basic solution and replenishment solution) | |
|---|---|
| Ammonium thiosulfate | 70.0 g |
| Sodium sulfite (anhydrous) | 17.0 g |
| Ammonium ethylenediamine iron (III) tetraacetate | 55.0 g |
| Disodium ethylenediamine tetraacetate | 5.0 g |
| Water: sufficient quantity to bring the total volume of the solution to: | 1.0 l |
| pH (adjusted with acetic acid) | 6.0 |
| **Stabilizing solution (as both basic solution and replenishment solution)** | |
| 2-aminobenzothiazol | 0.1 g |
| 1-hydroxyalkylidene-1-diphosphonic acid | 4.0 g |
| Water: sufficient quantity to bring the total volume of the solution to: | 1.0 l |
| pH (adjusted with sodium hydroxide) | 7.0 |
| The result of the test is as shown in Table 9. | |

TABLE 9

| Test No. | Anti-precipitation agent | Replenishing solution | State of precipitate of flowing liquid |
|---|---|---|---|
| 30 | (22), 0.3 g | I | No precipitate at −5° C. |
| 31 | p-Ts, 20.0 g | II | Precipitate appear at 10° C. |
| 32 | (20), 0.3 g | II | No precipitate at −5° C. |

p-Ts in Table 9 is paratoluenesulfonate.

Although concentration of the color developing agents in flowing liquid is reduced in a quantity corresponding to the quantity consumed by the developing process, the overall condition of the liquid is not necessarily improved, due to various factors including condensation of the process solution resulted from evaporation and accumulation of eluting materials. Compared with replenishment solution, flowing liquid is subject to more negative conditions, such as that crystal nucleus, which is prone to invite precipitation of color developing agent, tends to be generated around the driving section of an automatic developing processing. Therefore, as shown in the result of Test No. 31, precipitation of materials tends to occur in flowing liquid when the temperature is low. However, as is seen from the results of the above experiments, continuous processing with ultra-low replenishment of highly concentrated replenishing solution is possible without occurrence of precipitation of color developing agent in flowing liquid by using color developer composition according to the present invention (Test Nos. 30 and 32).

As has been shown in the foregoing, according to the present invention, compositions of color developing agents containing a paraphenylenediamine type developing agent and any of compounds given by the general formula according to the invention or salts thereof have excellent stability, give out no odor and are capable of performing stable photographic processing as well as restraining precipitation of color developing agent from color developer composition which contains the color developing agent in a high concentration. According to the present invention, it is also possible to obtain highly concentrated color developer composition which is capable of preventing, by means of adding a compound according to the invention, precipitation of color developing agent in processing an exposed silver halide color photographic material with replenishment solution being supplied at extremely low volume.

What is claimed is:

1. A composition of a color developing replenishment solution for continuously processing a silver halide color photographic material, said composition comprising a paraphenylenediamine type color developing agent and an amino selected from the group consisting of compounds 1, 2, 3, 4, 9, 11, 12, 17, 18, 19, 20, 21, 22, 23, 24, 25, 26, 28, 29, 31, 30, and salts thereof.

(1)

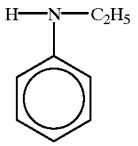

(2)

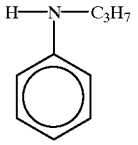

(3)

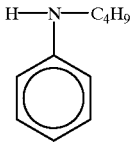

(4)

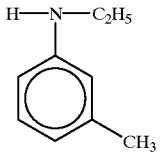

(9)

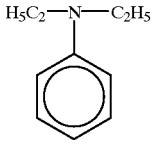

(11)

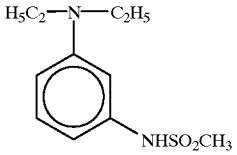

-continued (12)

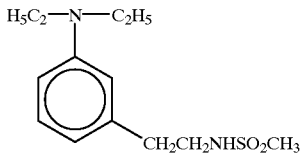

(17)

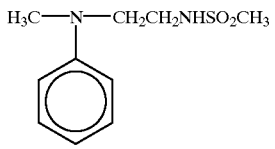

(18)

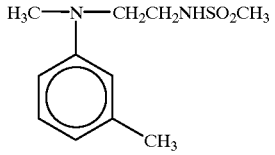

(19)

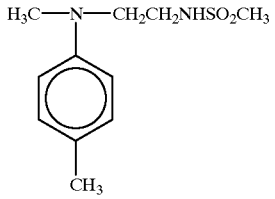

(20)

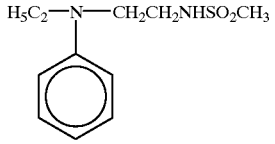

(21)

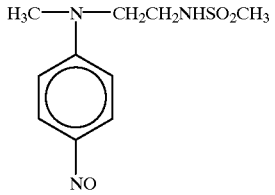

(22)

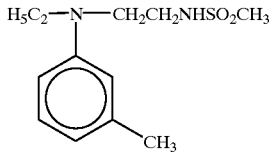

(23)

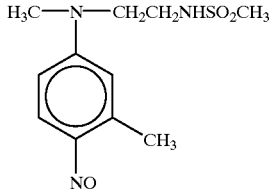

-continued (24)

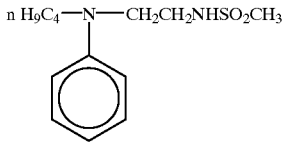

(25)

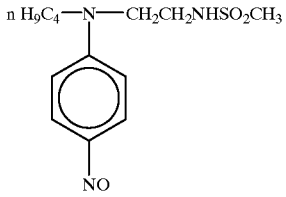

(26)

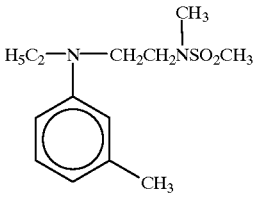

(28)

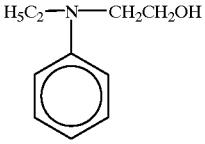

(29)

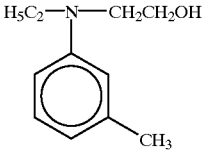

(30)

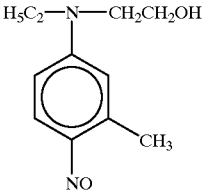

(31)

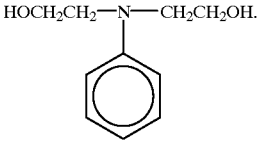

2. The composition of a color developing agent for processing a silver color photographic material as claimed in claim 1, wherein said paraphenylene diamine type color developing agent is 4-amino-3-methyl-N-ethyl-N-(β-methylsulfonamidoethyl)aniline 3/2-sulfate 1-hydrate.

3. The composition of a color developing agent for processing a silver halide color photographic material as claimed in claim 1, wherein said paraphenylene diamine type color developing agent is 4-amino-3-methyl-N-ethyl-N-(β-hydroxyethyl)aniline sulfate 1-hydrate.

4. The color developer composition for processing a silver halide color photographic material as claimed in claim 1, wherein said color developer composition contains at least $2.0\times10^{-2}$ mol/l of paraphenylene diamine type color developing agent.

* * * * *